US009455071B2

(12) United States Patent
Sumi et al.

(10) Patent No.: US 9,455,071 B2
(45) Date of Patent: Sep. 27, 2016

(54) NOISE SUPPRESSION CABLE

(71) Applicant: Hitachi Metals, Ltd., Toyko (JP)

(72) Inventors: Yosuke Sumi, Hitachinaka (JP); Naofumi Chiwata, Mito (JP); Katsuya Akimoto, Hitachi (JP); Katsutoshi Nakatani, Hitachi (JP); Hiroshi Komuro, Hitachi (JP); Kenji Ajima, Hitachiota (JP); Hiroshi Okikawa, Hitachi (JP); Yasuharu Muto, Kitaibaraki (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 14/732,514

(22) Filed: Jun. 5, 2015

(65) Prior Publication Data

US 2015/0357087 A1 Dec. 10, 2015

(30) Foreign Application Priority Data

Jun. 10, 2014 (JP) ..... 2014-119904

(51) Int. Cl.
*H01B 11/06* (2006.01)
*H01B 11/10* (2006.01)

(52) U.S. Cl.
CPC ..... *H01B 11/1083* (2013.01)

(58) Field of Classification Search
CPC ..... H01B 11/1083
USPC ..... 174/36, 102 SC; 333/12
See application file for complete search history.

(56) References Cited

U.S. PATENT DOCUMENTS 6,239,379 B1 * 5/2001 Cotter ..... G02B 6/4416 174/110 R
2010/0289609 A1 * 11/2010 Liao ..... H01F 17/04 336/221

FOREIGN PATENT DOCUMENTS

JP 11-329089 A 11/1999
JP 2004-158328 A 6/2004
WO WO 2012/132589 * 10/2012

* cited by examiner

*Primary Examiner* — Chau N Nguyen
(74) *Attorney, Agent, or Firm* — McGinn IP Law Group, PLLC

(57) ABSTRACT

A noise suppression cable includes a conductor wire, and a magnetic insulation layer on a periphery of the conductor wire. The magnetic insulation layer includes an insulating material and two or more types of magnetic powders that have different frequency characteristics from each other.

4 Claims, 2 Drawing Sheets

NOISE SUPPRESSION CABLE

The present application is based on Japanese patent application No. 2014-119904 filed on Jun. 10, 2014, the entire contents of which are incorporated herein by reference.

BACKGROUND OF THE INVENTION

1. Field of the Invention

The invention relates to a noise suppression cable.

2. Description of the Related Art

An electromagnetic shielded cable capable of reducing electromagnetic wave noise over a wide band has been proposed. The electromagnetic shielded cable is configured such that a shielding member interposed between a conductor and an insulation cover covering the conductor is composed of three layers, a layer formed of a synthetic rubber mixed with a high-frequency magnetic powder, a layer formed of a synthetic rubber mixed with an intermediate-frequency magnetic powder and a layer formed of a synthetic rubber mixed with a low-frequency magnetic powder (see e.g. JP-A-H11-329089).

Also, a noise suppression cable has been proposed in which an insulated wire formed by covering a conductor with an insulation is sequentially covered with a shielding and then with a sheath layer. The sheath layer includes a magnetic powder-mixed-resin layer formed of a mixture of a resin and a magnetic powder, and a mixture ratio of the magnetic powder to the resin in the magnetic powder-mixed-resin layer is 30 to 70 vol % (see e.g. JP-A-2004-158328).

SUMMARY OF THE INVENTION

The manufacture of the electromagnetic shielded cable disclosed in JP-A-11-329089 may take time and effort since it is essential to provide the three-layered shielding member between the conductor and the insulation cover.

The noise suppression cable disclosed in JP-A-2004-158328 may not sufficiently suppress the electromagnetic wave noise emitted from the cable due to the mixture ratio of the magnetic powder.

It is an object of the invention to provide a noise suppression cable that is capable of reducing the electromagnetic wave noise in a wide band and is easy to manufacture.

(1) According to one embodiment of the invention, a noise suppression cable comprises:

a conductor wire; and a magnetic insulation layer on a periphery of the conductor wire, wherein the magnetic insulation layer comprises an insulating material and two or more types of magnetic powders that have different frequency characteristics from each other.

In the above embodiment (1) of the invention, the following modifications and changes can be made.

(i) At least one of the two or more types of magnetic powders comprises a flat-shaped magnetic powder, and whether a flat direction or in-plane direction of the flat-shaped magnetic powder is oriented along a longitudinal direction and a circumferential direction of the cable.

(ii) A flattening ratio represented by maximum length/thickness of the flat-shaped magnetic powder is not less than 2 and not more than 50.

(iii) A mixture ratio of the two or more types of magnetic powders to the insulating material in the magnetic insulation layer is 5 to 60 vol %.

(iv) The noise suppression cable further comprises a second magnetic insulation layer on a periphery of the magnetic insulation layer, wherein the second magnetic insulation layer comprises at least one type of magnetic powder that has a different frequency characteristic from the two or more types of magnetic powders.

Effects of the Invention

According to one embodiment of the invention, a noise suppression cable can be provided that is capable of reducing the electromagnetic wave noise in a wide band and is easy to manufacture.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

Figure 1:
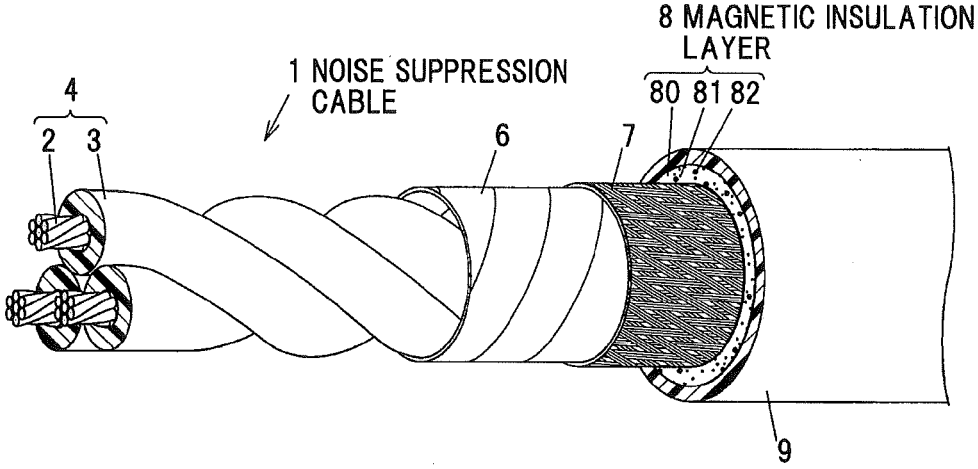
FIG. 1 is a perspective view showing a noise suppression cable in a first embodiment of the present invention.

Embodiments of the invention will be described below in reference to the drawings. It should be noted that constituent elements having substantially the same functions are denoted by the same reference numerals in each drawing and the overlapping explanation thereof will be omitted.

First Embodiment

Figure 2:
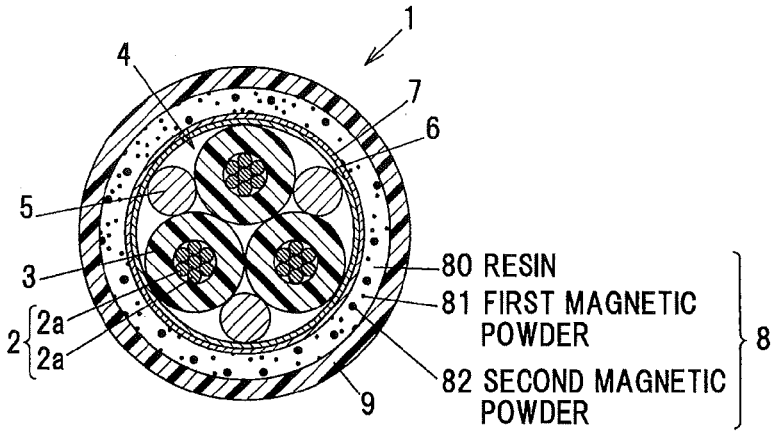
FIG. 2 is a cross sectional view showing the noise suppression cable shown in FIG. 1.
Figure 3:
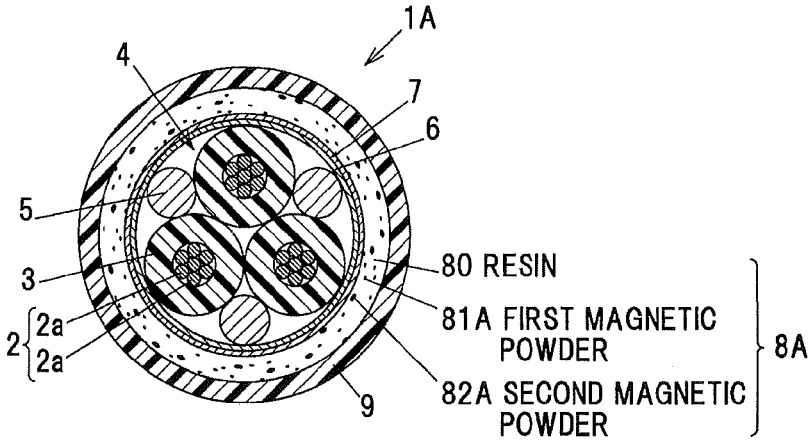
FIG. 3 is a cross sectional view showing a modification of the noise suppression cable shown in FIG. 1.

FIG. 1 is a perspective view showing a general configuration of a noise suppression cable in the first embodiment of the invention. FIG. 2 is a cross sectional view showing the noise suppression cable shown in FIG. 1. FIG. 3 is a cross sectional view showing a modification of the noise suppression cable shown in FIG. 1. An illustration of inclusions 5 is omitted in FIG. 1.

A noise suppression cable 1 shown in FIGS. 1 and 2 is provided with plural insulated wires 4 (three in the first embodiment) each formed by covering a conductor wire 2 with an insulation 3, a resin tape layer 6 wound around the plural insulated wires 4 with inclusions 5 interposed therebetween, a shield layer 7 provided around the resin tape layer 6, a magnetic insulation layer 8 provided around the shield layer 7 and a sheath 9 as an insulating protective layer formed of a resin, etc., and provided around the magnetic insulation layer 8.

The conductor wire 2 is formed by twisting plural thin metal wires 2*a* (seven in the first embodiment) together. The insulated wire 4 transmits a signal of, e.g., 1 MHz to 10 GHz. The number of the insulated wires 4 is more than one in the first embodiment but may be one. In addition, the insulated wire 4 may be a twisted wire pair which transmits differential signals.

The resin tape layer 6 is formed by, e.g., winding a resin tape around the plural insulated wires 4 with the inclusions 5 interposed therebetween throughout a longitudinal direction of the cable. As the rein tape, it is possible to use, e.g., a tape formed of a resin such as polyethylene terephthalate (PET) or polypropylene-based resin.

The shield layer 7 is formed by braiding conductive wires and is connected to a ground. Alternatively, the shield layer 7 may be formed by winding a tape with a conductor attached thereto.

The magnetic insulation layer 8 is a single magnetic insulation layer formed of a mixture of a resin 80 as an insulating material and two or more types of magnetic powders having different frequency characteristics from one another. In the first embodiment, the magnetic insulation layer 8 is formed by extruding the resin 80 containing a first magnetic powder 81 and a second magnetic powder 82 having different frequency characteristics therefrom. It is exemplary to mix two to six types, more exemplarily two to five types, further exemplarily three to four types, of magnetic powders having different frequency characteristics from one another. "Different frequency characteristics" here means different magnetic permeability and different frequency range allowing a noise reduction effect to be obtained.

As the base resin 80, it is possible to use, e.g., olefin-based resin, vinyl chloride resin, ethylene vinyl acetate polymer, fluorine-based resin and silicone-based resin, etc. In addition, the resin 80 is exemplarily crystalline rather than amorphous for orienting the flat direction of magnetic powder along longitudinal and circumferential direction of the cable in a modification described later.

A mixture ratio of the magnetic powders 81 and 82 to the resin 80 is exemplarily 5 to 60 vol %, more exemplarily, 10 to 40 vol % in view of both flexibility of cable and electromagnetic wave noise suppression effect.

As the first magnetic powder 81, it is possible to use magnetic powder which has a relative magnetic permeability of, e.g., 1,000 to 100,000 and provides an effect of reducing noise in a high-frequency band. Meanwhile, as the second magnetic powder 82, it is possible to use magnetic powder which has a relative magnetic permeability of, e.g., 1,000 to 100,000 and provides an effect of reducing noise in a low-frequency band. In case that three or more types of magnetic powders having different frequency characteristics from one another are mixed to the resin 80 constituting the magnetic insulation layer 8, for example, a below-described third magnetic powder 84, etc., can be mixed in addition to the magnetic powders 81 and 82.

Materials of the first and second magnetic powders 81 and 82 are exemplarily soft magnetic materials. As the soft magnetic material, it is possible to use, e.g., ferrite powder such as Mn—Zn ferrite powder, Ni—Zn ferrite powder or Ni—Zn—Cu ferrite powder, and soft magnetic metal powder such as Fe—Ni alloy (permalloy), Fe—Si—Al alloy (sendust) or Fe—Si alloy (silicon steel).

The shape of the first magnetic powder 81 and the second magnetic powder 82 is not specifically limited and can be a granular form (a spherical shape), a flat shape as shown in the modification, an oval shape, a rod shape or a fibrous shape, etc. Of those, the flat shape is exemplary.

The thickness of the magnetic insulation layer 8 is not specifically limited but is exemplarily from 100 to 1,000 μm.

A noise suppression cable 1A shown in FIG. 3 is a modification of the noise suppression cable 1 shown in FIG. 1 and is basically the same as the noise suppression cable 1 except that a first magnetic powder 81A and a second magnetic powder 82A each having a flat shape are used instead of the first magnetic powder 81 and the second magnetic powder 82. Both the first and second magnetic powders have a flat shape in this modification. It is acceptable that only one of the first and second magnetic powders has a flat shape but it is exemplary that both have a flat shape. Meanwhile, in case that three types of magnetic powders are mixed, it is exemplary that one or more types, more exemplarily two or more types, further exemplarily all of the three types of magnetic powders have a flat shape. The same applies to the case where four or more types of magnetic powders are mixed.

In case that the first and second magnetic powders 81A and 82A have a substantially disc shape, extrusion-molding a mixture of the resin 80 and the first and second magnetic powders 81A and 82A causes a flat direction (an in-plane direction) of the first and second magnetic powders 81A and 82A to be oriented along the longitudinal direction (extrusion direction) and circumferential direction of the cable. In other words, the flat surface of the first and second magnetic powders 81A and 82A is substantially parallel to the longitudinal and circumferential directions of the cable. "Substantially parallel" includes the case where the flat surface is inclined at not less than 0° and not more than 30° with respect to the longitudinal and circumferential directions of the cable. The inclination is exemplarily not more than more than 20°, more exemplarily not more than more than 10°, and further exemplarily not more than more than 5°.

When the flattening ratio of the first and second magnetic powders 81A and 82A derived by the maximum length/thickness is less than 2, it is difficult to obtain a desired relative magnetic permeability. On the other hand, when the flattening ratio is more than 50, the magnetic powders are highly likely to be damaged during molding of a magnetic insulation layer 8A. Therefore, the flattening ratio of the first and second magnetic powders 81A and 82A is exemplarily not less than 2 and not more than 50, more exemplarily, not less than 10 and not more than 50. The size of the first and second magnetic powders 81A and 82A is exemplarily not less than 1 μm and not more than 20 μm in terms of minimum diameter. Not 100% of the first and second magnetic powders 81A and 82A need to satisfy the above-mentioned flattening ratio and it may be such that not less than 80% of the first and second magnetic powders 81A and 82A satisfies the above-mentioned flattening ratio and the remaining has the flattening ratio of less than 2.

The sheath 9 is formed of, e.g., the same resin as the resin 80 which is used as a base of the magnetic insulation layer 8 or 8A. A cover layer covering the shield layer 7 is formed to have a two-layer structure composed of the magnetic insulation layer 8 and the sheath 9, thereby adding more mechanical strength. Here, considering adhesion between the magnetic insulation layer 8 or 8A and the sheath 9 at an interfacial boundary, the magnetic insulation layer 8 or 8A and the sheath 9 may be simultaneously extruded to cover the outer periphery of the shield layer 7.

Second Embodiment

Figure 4:
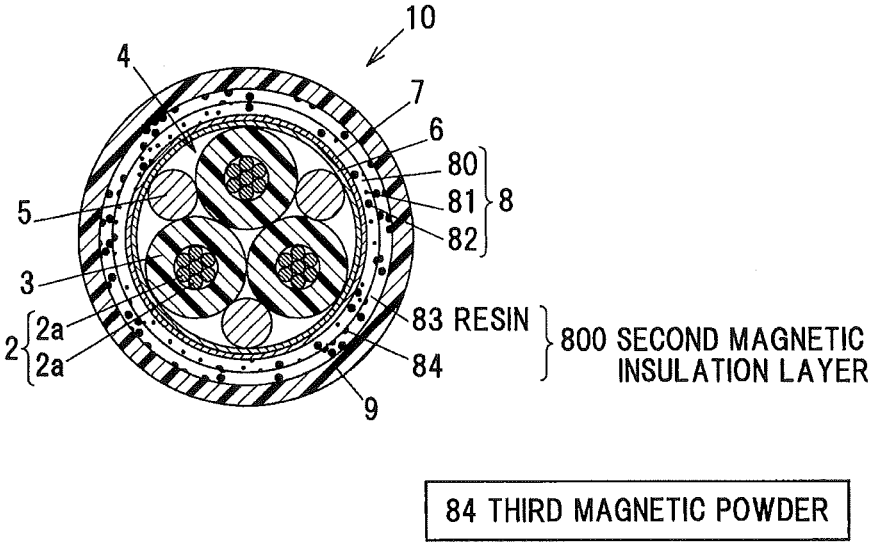
FIG. 4 is a cross sectional view showing a noise suppression cable in a second embodiment of the invention.

FIG. 4 is a cross sectional view showing a noise suppression cable in the second embodiment of the invention.

A noise suppression cable 10 shown in FIG. 4 is different from the noise suppression cable 1 in the first embodiment of the invention in that the periphery of the magnetic insulation layer 8 is covered with a second magnetic insulation layer 800 which is formed of a mixture of a resin 83 as an insulating material and the third magnetic powder 84 having different frequency characteristics from the first and second magnetic powders 81 and 82. Although only the third magnetic powder 84 is mixed to the resin 83 in the second embodiment, two or more types of magnetic powders having different frequency characteristics from the first and second magnetic powders 81 and 82 may be mixed.

The material of the resin 83 may be same as or different from the material of the resin 80.

As the third magnetic powder 84, it is possible to use magnetic powder which has a relative magnetic permeability of, e.g., 1,000 to 100,000 and provides an effect of reducing noise in an intermediate-frequency band.

It is exemplary that the third magnetic powder 84 also have a flat shape, as is the modification shown in FIG. 3.

In the second embodiment, the magnetic insulation layer 8 is exemplarily 100 to 1,000 μm in thickness and the second magnetic insulation layer 800 is also exemplarily 100 to 1,000 μm in thickness.

Effects of the Embodiments

The following effects can be obtained in the embodiments.

(1) It is possible to provide a noise suppression cable which is capable of reducing electromagnetic wave noise over a wide band and is easy to manufacture.

(2) By using the flat-shaped magnetic powders and orienting the flat direction thereof along the longitudinal and circumferential directions of the cable, impedance is increased as compared to the case of using granular magnetic powders mixed at the same ratio as that in the embodiments. This allows electromagnetic wave noise (emission noise) emitted from the cable to be suppressed more effectively.

(3) By using the flat-shaped magnetic powders and orienting the flat direction thereof along the longitudinal and circumferential directions of the cable, it is possible to reduce the amount of magnetic powders for obtaining an electromagnetic wave noise suppression effect equivalent to that in the case of using granular magnetic powder.

(4) It is not necessary to use a ferrite core. Therefore, an appearance is better, problems during handling such as cracks on the ferrite core do not arise, and it is possible to suppress electromagnetic wave noise emission without increasing an outer diameter of the cable.

The invention is not limited to the embodiments described above and can be embodied in various ways.

In addition, some of the constituent elements in the embodiments can be omitted or changed without changing the gist of the invention. For example, the inclusion 5 may be omitted as long as no problem arises when winding a resin tape around the plural insulated wires 4.

In the embodiments, the magnetic insulation layer 8 formed around the shield layer 7 has been explained as an insulation layer formed around a conductor wire. However, instead of using the magnetic insulation layer 8 or together with the magnetic insulation layer 8, the insulation 3 covering the conductor wire 2 may contain first and second magnetic powders.

What is claimed is:

1. A noise suppression cable, comprising:

a conductor wire;

a magnetic insulation layer on a periphery of the conductor wire, wherein the magnetic insulation layer comprises an insulating material and two or more types of magnetic powders that have different frequency characteristics from each other; and a second magnetic insulation layer on a periphery of the magnetic insulation layer, wherein the second magnetic insulation layer comprises at least one type of magnetic powder that has a different frequency characteristic from the two or more types of magnetic powders.

2. The noise suppression cable according to claim 1, wherein at least one of the two or more types of magnetic powders comprises a flat-shaped magnetic powder, and wherein a flat direction or in-plane direction of the flat-shaped magnetic powder is oriented along a longitudinal direction and a circumferential direction of the cable.

3. The noise suppression cable according to claim 2, wherein a flattening ratio represented by maximum length/thickness of the flat-shaped magnetic powder is not less than 2 and not more than 50.

4. The noise suppression cable according to claim 1, wherein a mixture ratio of the two or more types of magnetic powders to the insulating material in the magnetic insulation layer is 5 to 60 vol %.

* * * * *